United States Patent [19]

Pearson

[11] Patent Number: 4,998,645

[45] Date of Patent: Mar. 12, 1991

[54] APPARATUS FOR DISPENSING THE CONTENTS OF A TUBE

[76] Inventor: John Pearson, 305 Johnson Dr., Shenandoah, Iowa 51601

[21] Appl. No.: 460,006

[22] Filed: Jan. 2, 1990

[51] Int. Cl.[5] ..... B65D 35/28

[52] U.S. Cl. ..... 222/98; 222/102; 222/162; 222/325; 222/391

[58] Field of Search ..... 222/98, 102, 105, 162, 222/191, 79, 214, 325, 336, 391, 392

[56] References Cited

U.S. PATENT DOCUMENTS

| | | | |
|---|---|---|---|
| 1,207,534 | 12/1916 | Gammeter | 222/102 |
| 2,357,351 | 10/1942 | Oliver | 222/102 |
| 3,249,258 | 3/1964 | Kramer et al. | 222/102 |

*Primary Examiner*—Andres Kashnikow
*Assistant Examiner*—Pamela Jordan
*Attorney, Agent, or Firm*—John A. Beehner

[57] ABSTRACT

The present invention includes a pistol like housing, a trigger activated ratchet controlled take up roller adapted for removably receiving the squeeze end of a collapsible tube. A flexible tube guide having opposing ends, one end being connected to the take up roller so that rotation of the roller causes the guide to be rolled around the roller. Connected to the opposing end of guide is a generally U-shaped member adapted for removably receiving the open end of a collapsible tube. Also included is a pair of springed pinch rollers adapted for squeezing extrudable material from a collapsible tube.

12 Claims, 3 Drawing Sheets

APPARATUS FOR DISPENSING THE CONTENTS OF A TUBE

BACKGROUND OF THE INVENTION

The present invention is directed to a material dispenser and more particularly to a trigger actuated apparatus for dispensing material from a collapsible tube.

Collapsible tube containers have long been used for storing and dispensing products such as tooth paste, lotion, glue, caulk and the like. These tubes are awkward, unattractive, and wasteful.

Known to the art are several devices adapted for extruding material from a collapsible tube container. Crossley, U.S. Pat. No. 2,056,422, teaches a collapsible tube dispenser without a take up roller, a single pinch roller, and a rigid tube support that extends increasingly rearwardly as material is dispensed from a tube. Oliver, U.S. Pat. No. 2,357,351, teaches a collapsible tube dispenser without a take up roller, and a rigid tube support guide. Loria, et al., U.S. Pat. No. 2,936,097, teaches a collapsible tube dispenser utilizing a compression plate rather than pinch rollers to squeeze material from a tube. Joines, U.S. Pat. No. 3,308,836, teaches of an apparatus capable of extruding material from a non-collapsible tube. Finally, Allen, U.S. Pat. No. 3,481,510, teaches the use of a trigger activated screw for dispensing material from a non-collapsible tube.

These devices are complex, cumbersome, difficult to load, and have limited adaptability. Additionally, many of these device have protruding tube support guides, and lack a means for neatly storing fully collapsed portions of a tube.

Accordingly, a primary object of the invention is to provide an improved apparatus for dispensing material from a collapsible tube.

Another object of the invention is to provide an apparatus for dispensing material from a collapsible tube whereby the tube is supported by a flexible support guide.

Another object of the invention is to provide an apparatus for dispensing material from a collapsible tube whereby the tube is rolled onto a take up roller as the tube is collapsed.

Another object of the invention is to provide an apparatus for dispensing material from a collapsible tube whereby the tube is passed through a pair of pinch rollers in order to extract material from the tube.

Another object of the invention is to provide an apparatus that is similar in appearance to a pistol or handgun.

Another object of the invention is to provide an apparatus that is easy to use.

Another object of the invention is to provide an apparatus that is capable of dispensing extrudable material in uniform incremental amounts.

Another object of the invention is to provide an apparatus that is inexpensive to manufacture.

SUMMARY OF THE INVENTION

The present invention includes a pistol like housing, a trigger activated ratchet controlled take up roller adapted for removably receiving the squeeze end of a collapsible tube. A flexible tube guide having opposing ends, one end being connected to the take up roller so that rotation of the roller causes the guide to be rolled around the roller. Connected to the opposing end of guide is a generally U-shaped member adapted for removably receiving the open end of a collapsible tube.

Also included is a pair of springed pinch rollers adapted for squeezing extrudable material from a collapsible tube.

The squeeze end of a tube containing extrudable material may be mounted on the take up roller. The open end of a tube may then be snapped into the generally U-shaped member of the flexible support guide whereby the tube is supported by the guide. By squeezing the trigger mechanism the take up roller is rotated, and the collapsible tube is passed between the pinch rollers before it and the support guide are wound around the take up roller in order to incrementally dispense extrudable material from a collapsible tube.

DESCRIPTION OF THE PREFERRED EMBODIMENT

Figure 1:
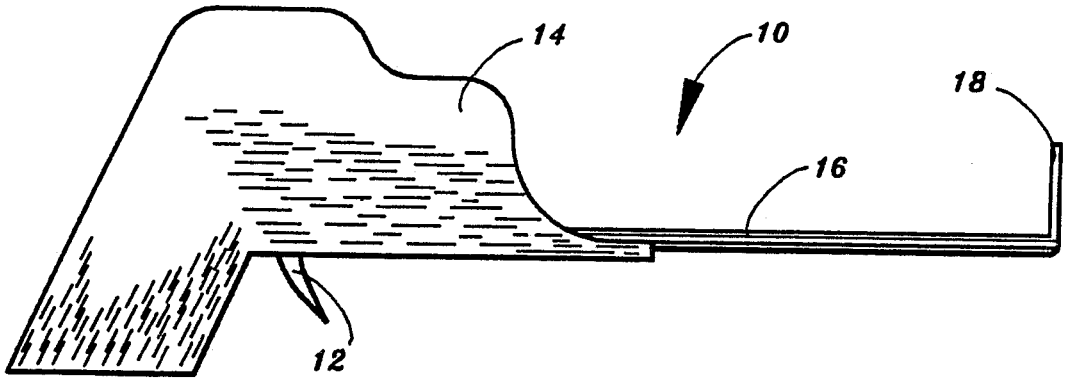
FIG. 1 is a side elevational view of the collapsible tube dispenser.

The apparatus 10 for dispensing material from a collapsible tube 34 of the present invention is illustrated in the drawings as including a mechanism housing or frame 14 for supporting and containing a collapsible tube dispensing means.

Figure 6:
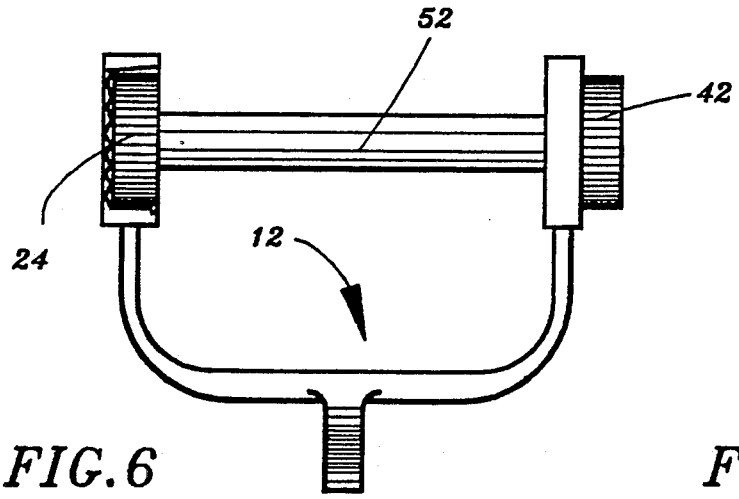
FIG. 6 is a front elevational view of the trigger 12, take up roller 52, ratchet 24 and pawl mechanism, and free wheel 42.

The collapsible tube dispensing means includes a trigger 12 and trigger spring 20 for actuating the rOtation of a take up roller 52. FIG. 6 shows the general U-shape of the trigger assembly 12. The take up roller 52 is rotatably secured by the trigger assembly 12. The take up roller 52 has opposing ends. Fixed to one opposing end is a ratchet 22 (FIGS. 2 and 4) having teeth 24, and fixed to the other opposing end is a free wheel 46 (FIG. 3) having free wheel teeth 42.

Figure 3:
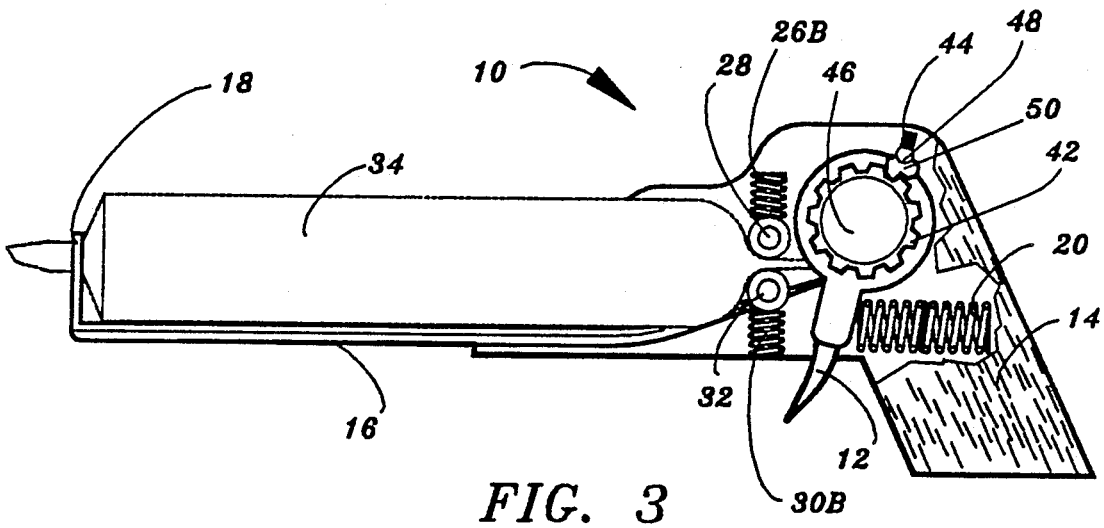
FIG. 3 is a partial sectional side elevational view showing a collapsible tube mounted for extruding material from the apparatus.

FIG. 3 shows how the free wheel teeth 42 are engaged by a free wheel pawl 50. Free wheel pawl 50 rocks on its base 48 and is urged toward free wheel 46 by a pawl spring 44 anchored in housing 14 to prevent counter-clockwise rotation of the free wheel 46.

Figure 2:
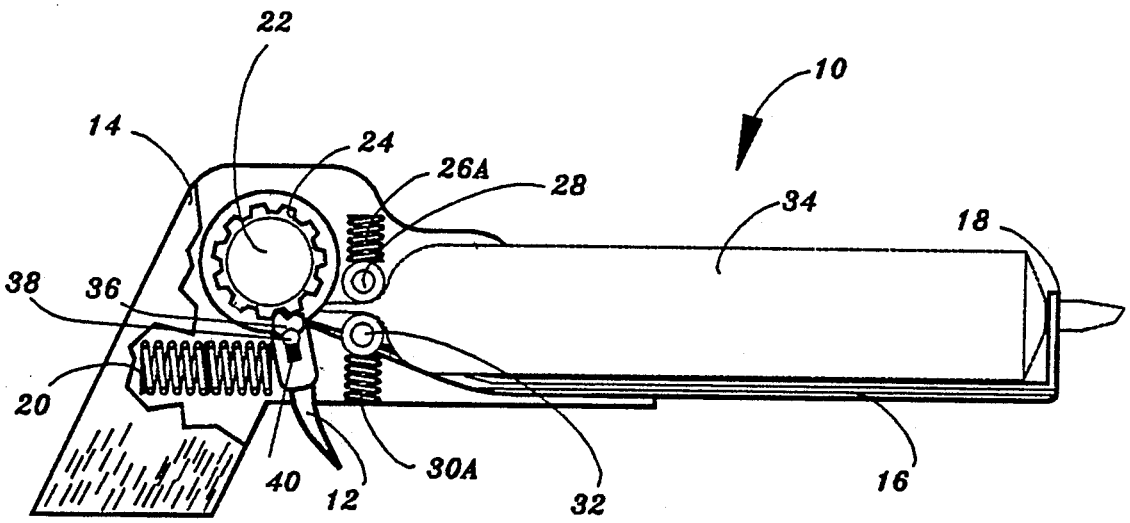
FIG. 2 is a partial sectional side elevational view showing a collapsible tube mounted for extruding material from the apparatus.
Figure 4:
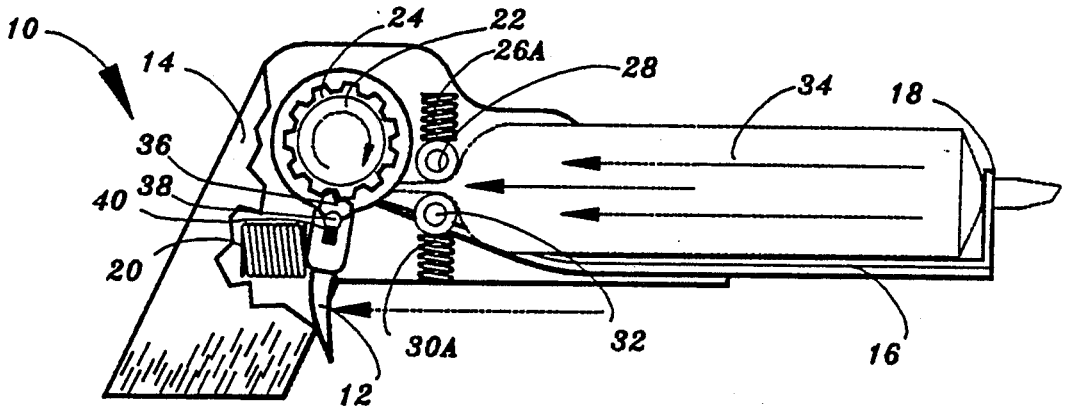
FIG. 4 is a partial sectional side elevational view showing the coacting trigger-pawl-ratchet means for rotating the take up roller 34 so that material is squeezed from a collapsible tube.
Figure 10:
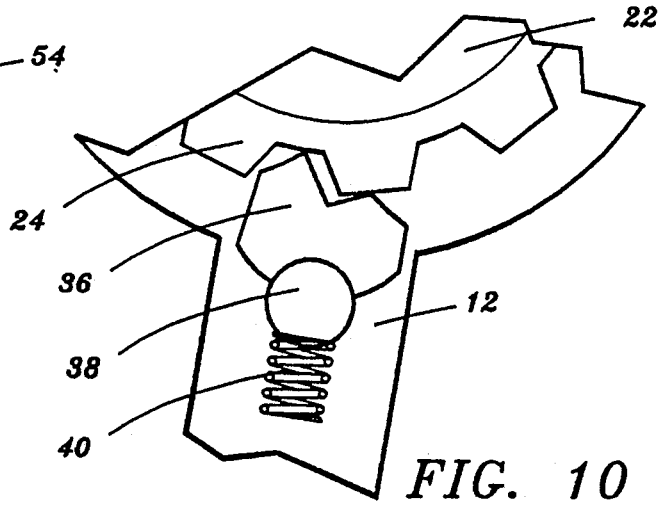
FIG. 10 is an enlarged sectional view of the ratchet-paw mechanism.

FIGS. 2, 4, and 10 show how the ratchet teeth 24 of the ratchet 22 are engaged by a ratchet pawl 36 which rocks on its base 38 and is urged toward ratchet 22 by a pawl spring 40 anchored in housing 14 below ratchet 22 for allowing clockwise rotation of the take up roller 52 upon actuation of the trigger assembly 12.

FIG. 4 shows how rearward depression of the trigger assembly 12 in the direction of the lowermost arrow causes the ratchet 22 and take up roller 52 to be rotated clockwise. The free wheel pawl $o locks the free wheel 46 and take up roller 52 into its new position. Upon release of the trigger 12 the trigger spring 20 resets the ratchet 22 and pawl 36 (FIGS. 1, 2, and 3) for the next depression of the trigger.

Figure 8:
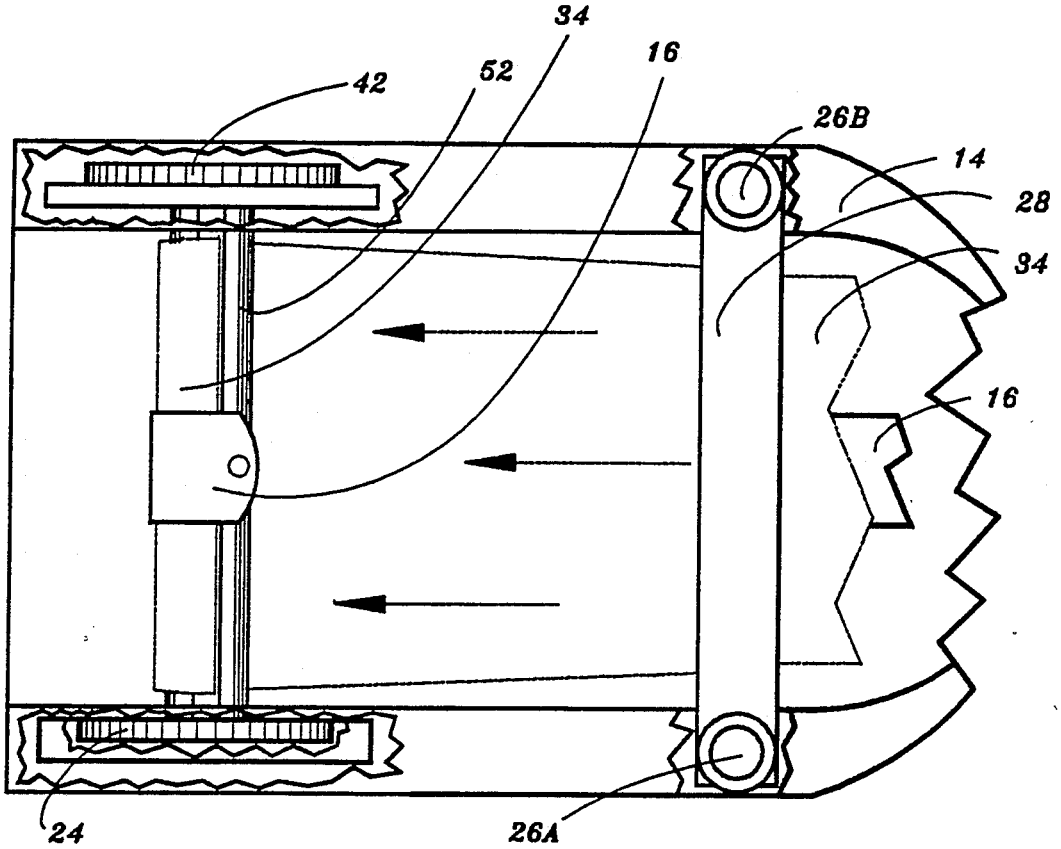
FIG. 8 is a partial sectional top plan view of the take up roller and pinch roller assemblies.

FIG. 8 shows the flexible tube support guide 16 attached to the take up roller 52. The flexible tube support guide 16 is included for removably supporting a collapsible tube 34.

Figure 5:
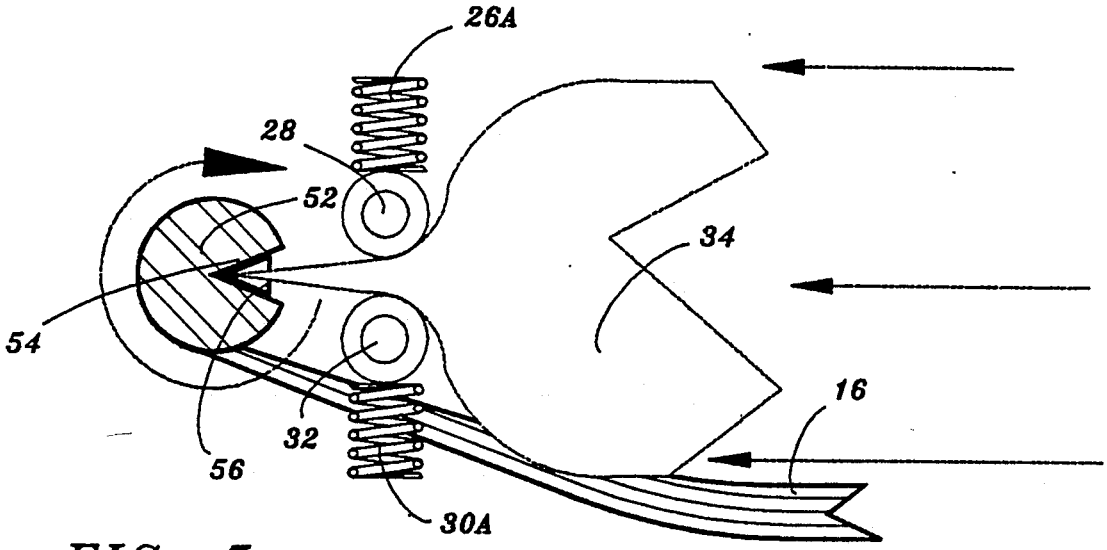
FIG. 5 is an enlarged sectional view showing the take up roller 52, pinch rollers 28 and 32, and pinch roller springs 26A and 30A.

FIGS. 5 and 8 show that rotation of the take up roller 52 causes the flexible tube support guide 16 to be wound around the take up roller 52.

Figure 9:
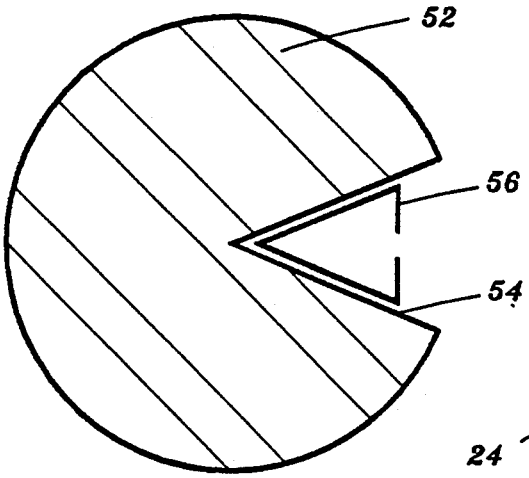
FIG. 9 is an enlarged side elevational view of the take u roller 52 and tube clamp 56 assemblies.

As shown by FIG. 9 the take up roller 52 has a generally V-shaped trough 54 formed along its surface. Fixed by attachment means (such as a pin, flange, or the like) within the trough 54 is a tube clamp 56 for removably securing a collapsible tube 34.

As shown by FIGS. 2, 3, 4, 5, and 8 the closed end of a collapsible tube may be passed between the pinch rollers 28 and 32 and then inserted into the tube clamp 56 (FIG. 5). The collapsible tube 36 is supported by the flexible tube support guide 16.

The upper pinch roller 28 rides on a pair of springs 26A and 26B, and the lower pinch roller 32 rides on a pair of springs 30A and 30B. The spring pinch roller combination forces the walls of the collapsible tube 36 together.

Figure 7:
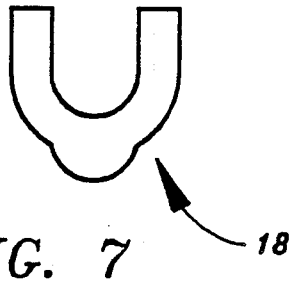
FIG. 7 is a front elevational view of the generally U-shaped guide 18 for removably receiving the open end of a collapsible tube.

Provided on the free end of the flexible tube support guide 16 is an upstanding generally U-shaped clamp 18 (FIG. 7) for removably securing the open end of the collapsible tube 36.

The closed end of the collapsible tube 36 containing an extrudable material is passed through the pinch rollers 28 and 32. The closed end of the collapsible tube 36 is then removably secured by the V-shaped clamp 56, and the open end of the collapsible tube is then removable secured by the U-shaped clamp 18. The body of he collapsible tube 36 is supported by the flexible tube support guide 16.

A party wishing to incrementally dispense an extrudable substance onto a surface may depress the trigger assembly 12 and thereby rotate the take up roller 52. Rotation of the take up roller 52 causes the collapsible tube 36 and flexible tube support guide 16 to be WOund around the take up roller 52; thereby causing the collapsible tube 36 to be drawn between the pinch rollers 28 and 32, forcing some of the contents of the collapsible tube 36 from the open end of the tube.

Whereas, the dimensions of the apparatus 10 are not critical, preferred embodiments of the apparatus are sized for dispensing the contents of conventional tubes of tooth paste, bath tube caulking, or "super glue."

Whereas, the apparatus 10 may be made of any rigid and durable material such as steel, aluminum, or plastic. The flexible tube support guide 16 of the preferred embodiment is made from a strip of spring steel like that used as rules for retractable tape measures. The strip has a shallow "U" cross sectional shape to resist downward bending of the free end when it is outstretched for supporting a collapsible tube 36.

Whereas, the invention has been disclosed in connection with a preferred embodiment thereof, it is apparent that many modifications, substitutions and additions may be made thereto which are within the intended broad scope of the appended claims.

Thus, there has been shown and described an apparatus and method of extruding material from a collapsible tube which accomplishes at least all of the stated objectives.

I claim:

1. An apparatus for incrementally dispensing material from a tube having an open end and a squeeze end, comprising a dispensing tool frame, a take up roller rotatably supported on said frame and adapted for removably receiving the squeeze end of a tube, a flexible tube support guide operatively associated with said roller whereby rotation of said roller causes said guide to be rolled on to said roller, said tube support guide being retractably supported by a portion of said frame and adapted for removably supporting a tube, a trigger means coacting with said take up roller such that actuation of said trigger means causes said take up roller to rotate and roll said tube and flexible tube support guide around said take up roller.

2. The apparatus of claim 1 wherein said dispensing tool frame comprises, a hand grip having upper, lower, forward, and rearward ends adapted to be held and supported by a human hand, an intermediate trigger housing portion having a trigger opening formed through the underside thereof, said intermediate trigger housing portion being connected to the upper end of said hand grip and extending forwardly beyond said forward end of said hand grip whereby said dispensing tool frame has a general pistol shape.

3. The apparatus of claim 1 further comprising a pair of tube squeeze end pinch rollers mounted forward of said take up roller on said dispensing tool frame.

4. The apparatus of claim 1 wherein the take up roller is generally cylindrical.

5. The apparatus of claim 4 wherein a cavity is formed into the take up roller for removably receiving the squeeze end of a tube.

6. The apparatus of claim 5 wherein said cavity formed in said take up roller is generally V-shaped.

7. The apparatus of claim 5 wherein there is provided a clamp on said take up roller adapted for removably securing the squeeze end of a tube to said take up roller.

8. The apparatus of claim 1 wherein said flexible tube support guide has a rearward end connected to said take up roller and adapted to be rolled around said take up roller, a forward end, and an upstanding generally U-shaped member mounted on said forward end of said flexible support guide and adapted to secure the open end of a tube.

9. The apparatus of claim 8 wherein the flexible tube support guide is formed of spring steel.

10. The apparatus of claim 9 wherein the flexible tube support guide has a shallow "U" cross sectional shape with a concave upper surface.

11. The apparatus of claim 1 wherein the coacting trigger means take up roller comprise, a pawl bar, having a forward ratchet engagement end, and a rearward trigger engagement end, a pawl spring, and a ratchet fixed to said take up roller whereby actuating said trigger will cause the take up roller to be rotated.

12. The apparatus of claim 11 wherein said ratchet pawl means, take up roller, and pair of pinch rollers are housed within said elongated trigger housing.

* * * * *